US010160034B2

(12) United States Patent
Wasserman

(10) Patent No.: US 10,160,034 B2
(45) Date of Patent: Dec. 25, 2018

(54) SIDEWAYS FORMING

(71) Applicant: National Machinery LLC, Tiffin, OH (US)

(72) Inventor: Stanley J. Wasserman, Fremont, CA (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 10 days.

(21) Appl. No.: 15/418,978

(22) Filed: Jan. 30, 2017

(65) Prior Publication Data

US 2018/0214931 A1 Aug. 2, 2018

(51) Int. Cl.
*B21J 9/02* (2006.01)
*B21J 9/04* (2006.01)

(52) U.S. Cl.
CPC ..... *B21J 9/027* (2013.01); *B21J 9/022* (2013.01); *B21J 9/04* (2013.01)

(58) Field of Classification Search
CPC ..... B21J 9/022; B21J 9/027; B21J 9/04; B21J 13/02; B21J 13/025; B21D 43/05; B21D 28/243; B21D 28/125
See application file for complete search history.

(56) References Cited

U.S. PATENT DOCUMENTS 5,829,302 A 11/1998 Hite
5,848,547 A 12/1998 Hite
8,485,013 B2 * 7/2013 Hossler ..... B21J 13/02 470/11

FOREIGN PATENT DOCUMENTS

DE 100 30 792 A1 1/2002
DE 10 2012 100340 A1 7/2013
JP 2011 025267 A 2/2011

* cited by examiner

*Primary Examiner* — Pradeep C Battula
(74) *Attorney, Agent, or Firm* — Pearne & Gordon LLP

(57) ABSTRACT

A progressive former having a bolster and a ram reciprocal towards and away from the bolster, a plurality of workstations evenly spaced across the bolster and ram including aligned tooling piece holders on the bolster and ram, cylindrical die cases in the tooling holders on the bolster and cylindrical tool cases in the tooling holders on the ram, the tooling cases at the workstations being coaxial, a sideways forming mechanism at one of said workstations, the mechanism including a cam and a cam follower radially outward of imaginary outward projections of the associated tooling cases, the cam follower being arranged to be activated by forward motion of the ram towards the bolster, the mechanism including a tool for forming the blank by applying a sideways force on the blank.

7 Claims, 4 Drawing Sheets

OK TO ENTER: /P.C.B/

SIDEWAYS FORMING

BACKGROUND OF THE INVENTION

The invention relates to improvements in progressive forming machines and, in particular, to tooling accessories for such machines.

PRIOR ART

Progressive formers shown, for example in U.S. Pat. Nos. 5,829,302 and 5,848,547 are well suited for making complex parts at high speeds and with little or no scrap. In such machines, a blank is typically cold formed at successive workstations by striking the blank with different tools that reciprocate in the same direction on a common slide or ram.

A need exists in the forming of certain products for a tool that moves in a path that is transverse to the motion of the ram. An example of such a product is a tubular part with a radial hole or holes through its sidewall.

SUMMARY OF THE INVENTION

The invention provides a tooling arrangement for a progressive cold former capable of forming a workpiece or blank with a forming blow or force transverse to the reciprocating direction of the ram of the machine. The disclosed arrangement utilizes sliding cam surfaces that convert ram motion to transverse or lateral motion for a tool element. The cam surfaces are outside of the swept or axially projected area of tool and die cases and are thereby enabled to be more robust than would ordinarily be practical. In a specifically disclosed arrangement, co-acting cam surfaces are both disposed on a stationary die side or bolster side of the machine and are actuated by tooling mounted on the ram.

The disclosed side motion tooling is arranged to pierce opposite sides of a hollow cylindrical wall of a blank to form circular holes in the wall by shearing out circular slugs. Prior to the actual piercing action, the blank is laterally gripped to lock it in place relative to the piercing pins and associated tooling elements. This gripping action reduces stresses on the pins which can otherwise cause premature failure of the pins.

The disclosed side forming mechanism is particularly suited for use on forming machines that use cassette tooling. Such machine arrangements can permit the mechanism to be carried on the tooling cassettes and thereby avoid major modification of existing machine structure.

DESCRIPTION OF THE PREFERRED EMBODIMENT

Figure 1:
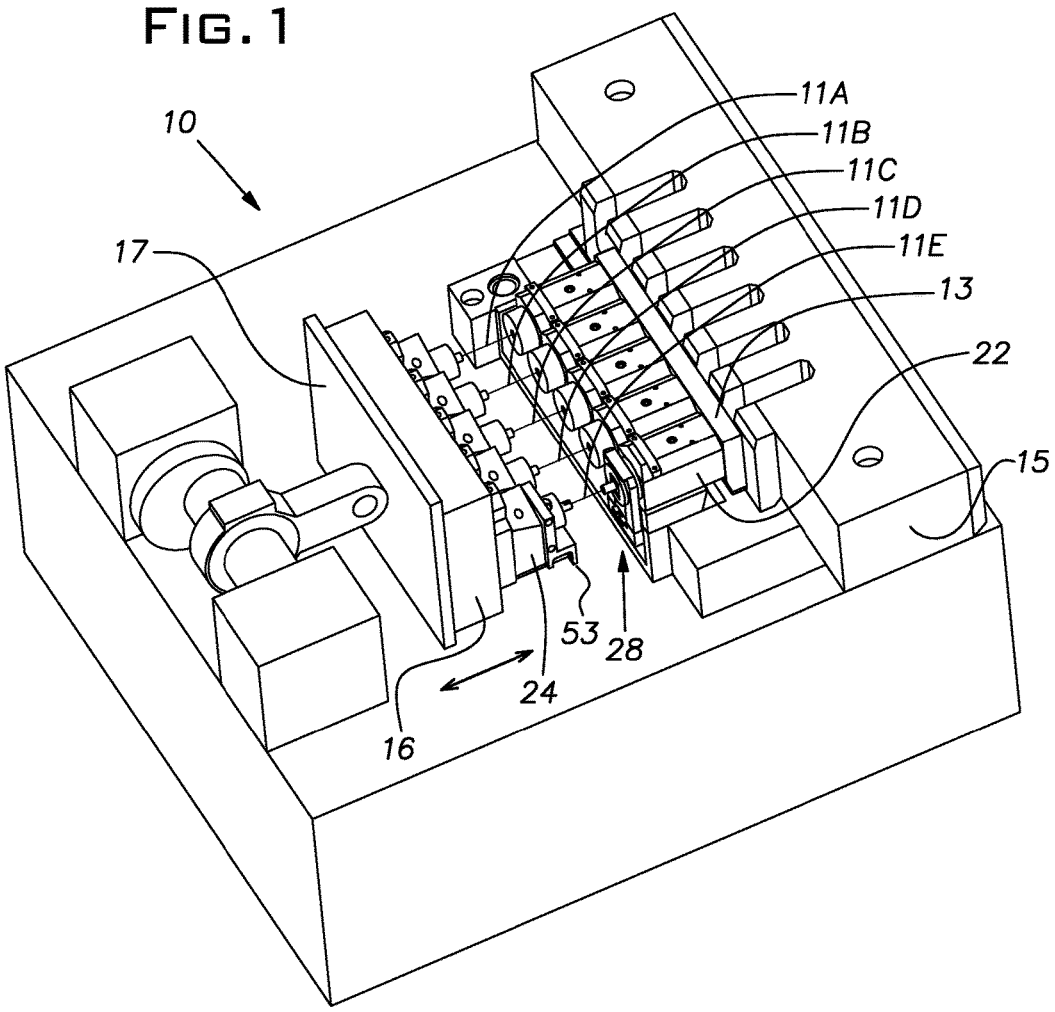
FIG. 1 is a diagrammatic perspective view of a progressive cold forming machine in which the invention is employed.

FIG. 1 schematically illustrates a progressive cold forming machine 10 generally known in the industry. Metal blanks or workpieces are mechanically transferred between workstations 11A-E where they are progressively shaped into a desired form. In the illustrated arrangement, individual die blocks or holders 22 are removably mounted on a die breast plate 13 fixed on a stationary bolster or die breast 15 at the workstations 11 and individual tool holders 24 are removably mounted on a housing 16 fixed to a reciprocating ram or slide 17 at individual workstations 11. The die blocks 22 and tool holders 24 each receive a generally cylindrical work die case and tool case, respectively; the cases at each station are coaxially aligned. Reciprocation of the ram 17 towards the die breast plate 13 causes tools in the die and tool cases to shape blanks at their respective workstations. As is customary, when the ram 17 is away from the die breast a transfer device (not shown) shifts the blanks horizontally to a successive workstation and ultimately to a discharge station.

Figure 2:
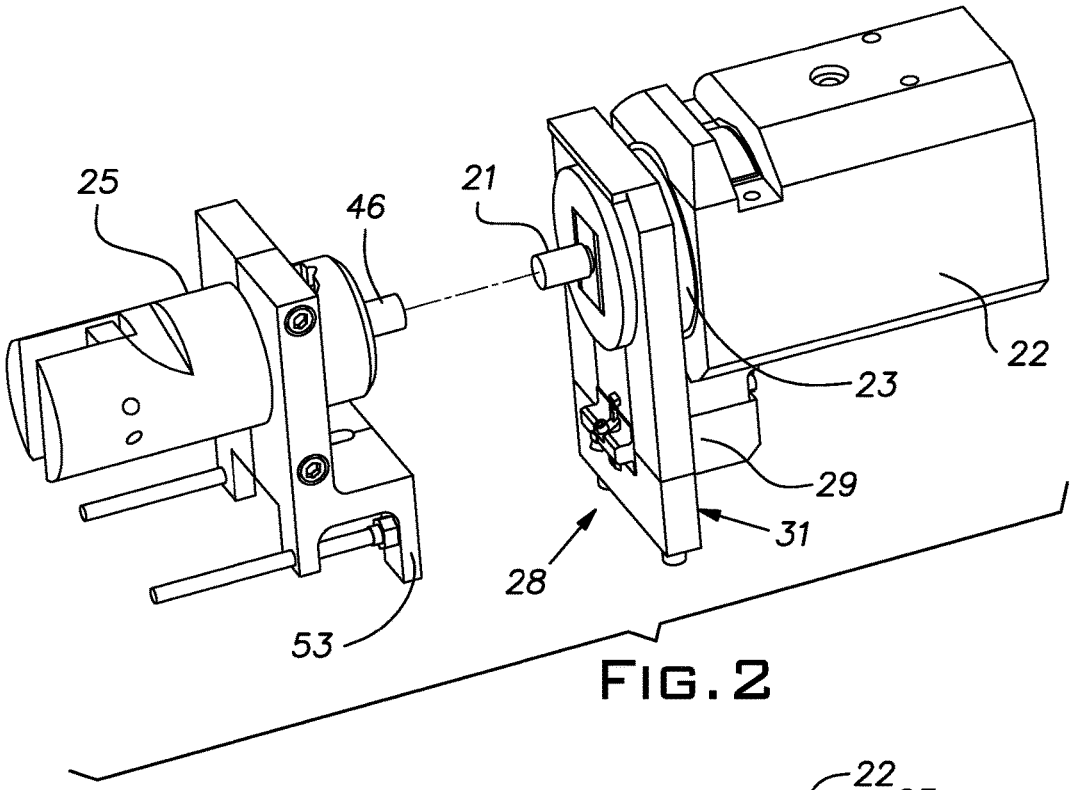
FIG. 2 is a diagrammatic perspective view of tooling elements embodying the invention.

In the present arrangement, the invention is utilized at the last workstation 11E, shown in the foreground in FIG. 1. The blank, typically, will be converted from a solid cylindrical slug to a hollow article or blank 21 illustrated in the figures. FIG. 2 illustrates tooling instrumentalities embodying the invention in relative spatial positions when the ram is at back dead center (BDC), furthest from the die breast 13.

The tooling includes a die block 22 removably fixed to the die breast plate 13, a generally cylindrical die case 23 received in the die block, a tool holder 24 removably fixed to the ram housing 16, and a generally cylindrical tool case 25 received in the tool holder.

The blank or workpiece 21 which, in the illustrated case as it is transferred to the last workstation 11E, is a hollow cylindrical article with an internal wall 26. The blank 21 is held immediately in front of the die case 23 by fingers of the transfer mechanism in a manner known in the art.

Figure 3:
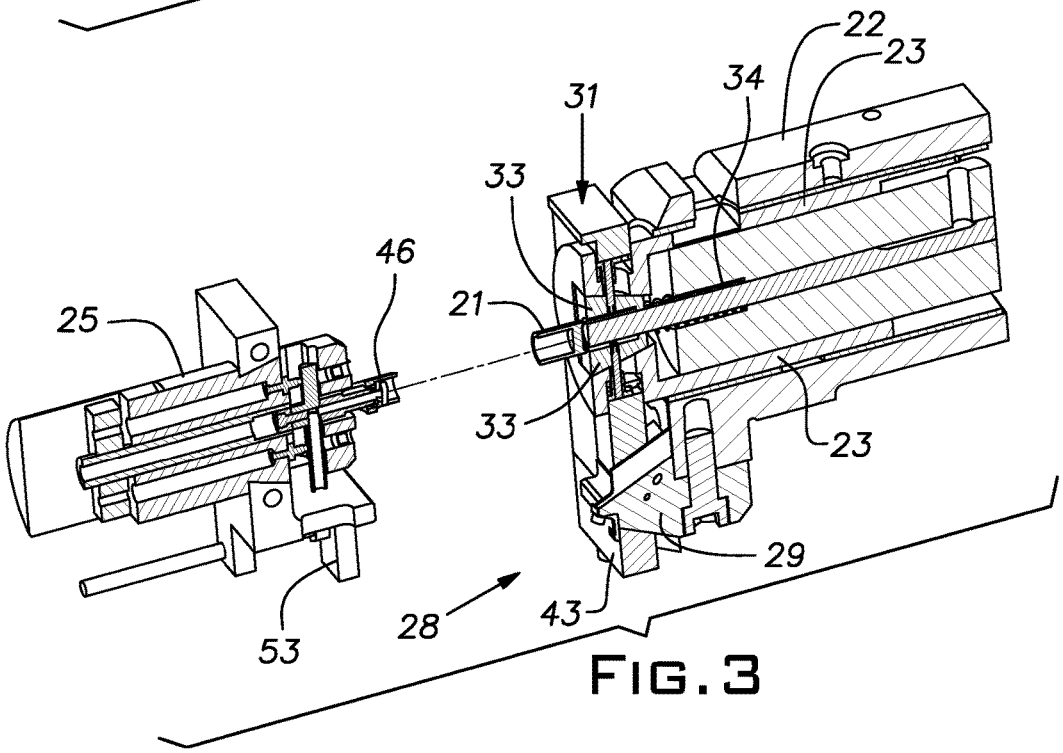
FIG. 3 is a cross-sectional view of the tooling elements of FIG. 2.

The die case 23, shown in a forwardmost position in FIGS. 2 and 3, is axially slidable a short distance in the die block 22. A side action mechanism 28 of the invention is assembled on the die breast side of the tooling. The mechanism 28 includes a cam 29 in the form of a flat face double side wedge fixed to a lower side of the die block 22. The mechanism 28 also includes a sideways tool driver 31 carried on the die case 23. As explained below, relative axial motion between the die case 23 and die block 22, when the tool case 25 contacts the die case 23 towards the end of a stroke of the ram 17 is converted to lateral or radial sideways motion in the side action mechanism 28 by the cam 29.

The section view of FIG. 3 illustrates details of the die block 22, die case 23, and side action mechanism 28. The die case 23 is resiliently held in the illustrated extended position relative to the die block 22 by gas springs (not shown) in the central area of the die case. Opposed blank grip wedges 33 at a mouth or entrance of the die case 23 are biased open by a spring 34 coaxial with the axis of the die case 23.

Figure 4:
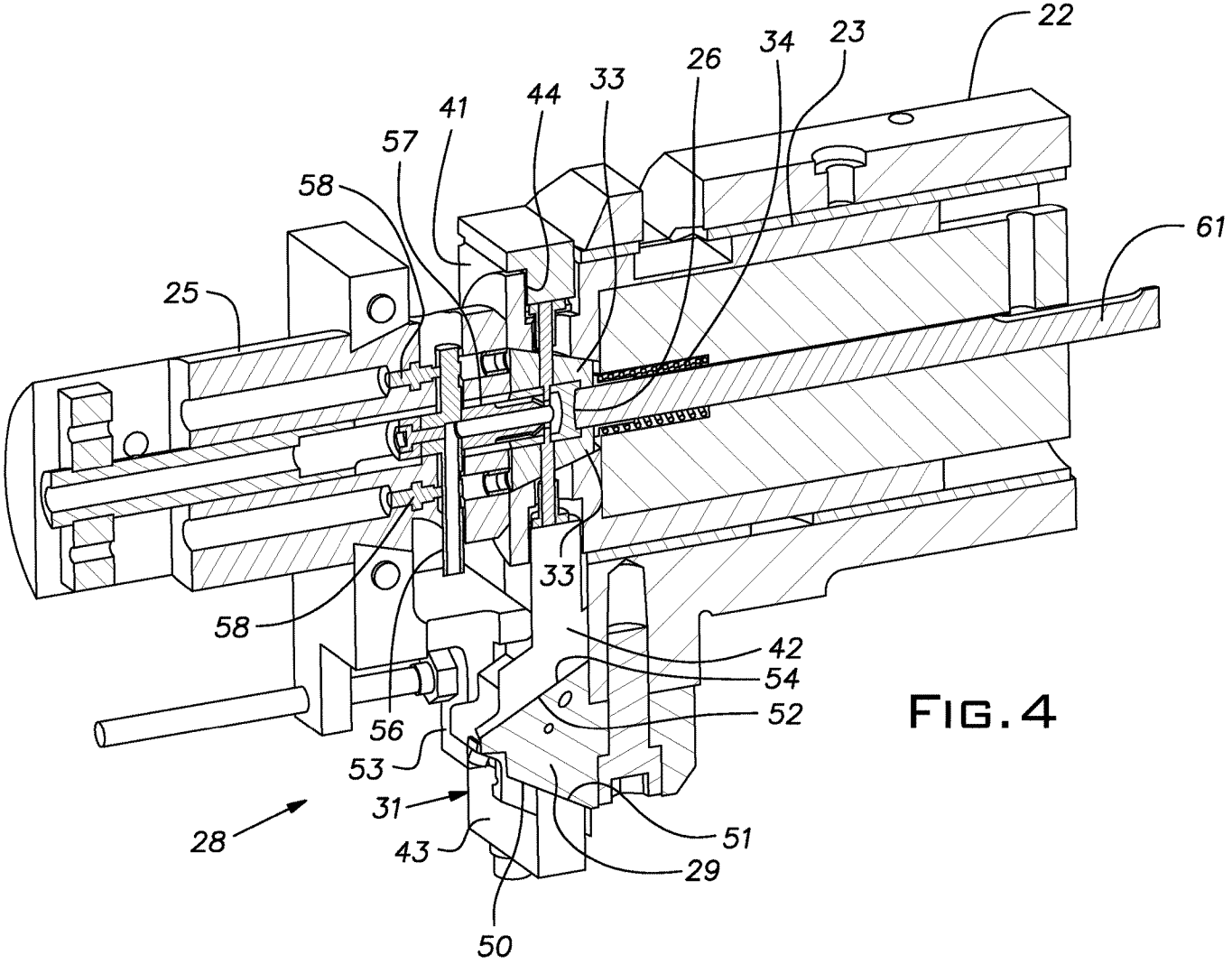
FIG. 4 is a cross-sectional view of the tooling elements fully engaged with a blank.
Figure 5:
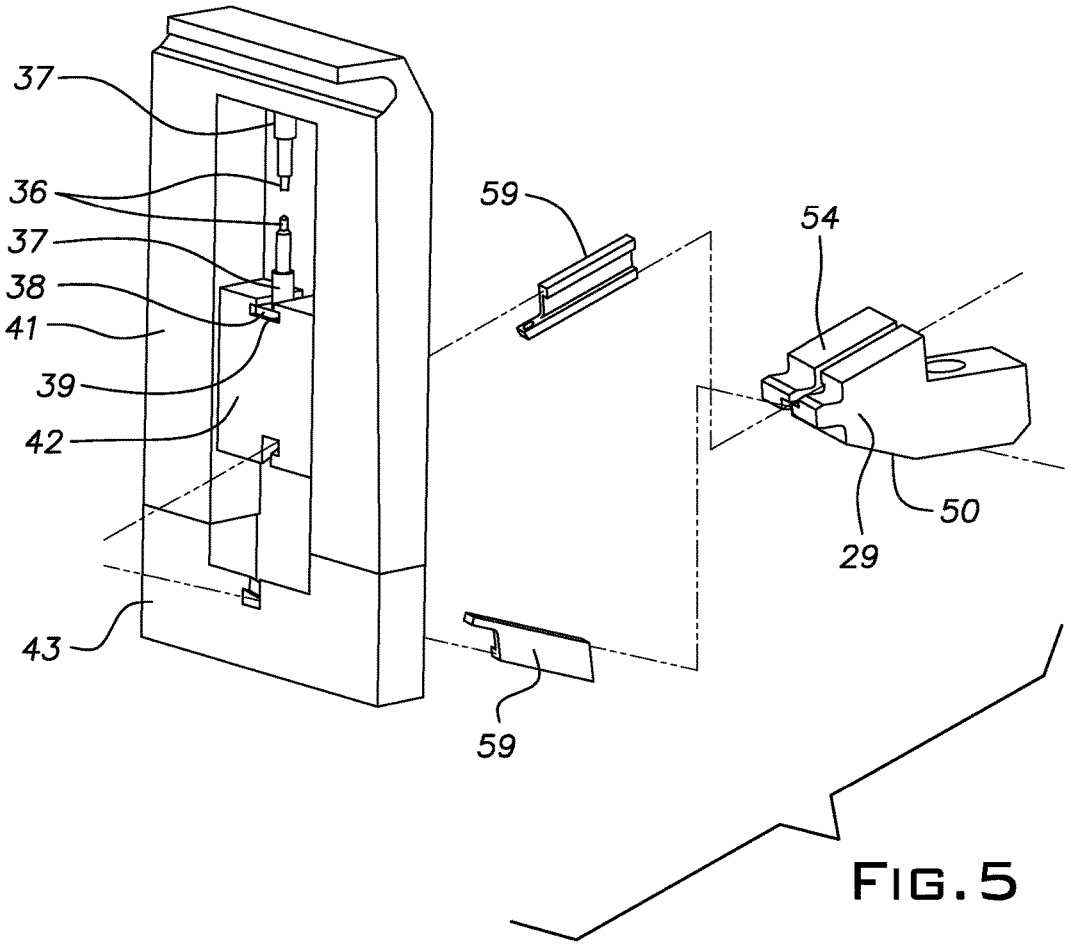
FIG. 5 is an exploded view of a pierce pin driver assembly and actuating cam.

In the illustrated embodiment, the side action mechanism 28 is arranged to pierce the workpiece or blank 21 on diametrically opposed sides. Pierce pins or tools 36, most clearly shown in FIG. 4, are received in radial guide holes in the wedges 33. The pierce pins 36 are fixed in respective retraction sleeves 37 preferably by a secure press fit. Flanges 38 at radially outer ends of the retraction sleeves 37 are captured in T-slots 39 (FIG. 5) of primary and secondary parts 41, 42 of the sideways tool driver 31. The primary driver part 41 (the primary driver) is an inverted rectangular U-shaped body and the secondary driver part 42 (secondary driver) is a plate shaped body between legs of the primary driver. The secondary driver 42 has tongues on opposite sides received in opposed grooves in the primary driver legs for limited motion in the plane of the primary driver 41. A cap 43 (FIG. 5) is bolted to the legs of the primary driver 41. FIGS. 2, 3 and 4 show that the die case 23 has a peripheral groove 44 in which the primary and secondary drivers 41, 42 are received. The drivers or slides 41, 42 translate in unison towards or away from one another in the groove 44 with axial movement of the die case 23 in the die block 22.

As the ram 17 advances the tool case 25 towards the die breast plate 13, a blank delivery sleeve at the center of and leading the tool case pushes the blank 21 into the die case 23 between the blank grip wedges 33. Thereafter, a projecting central area of the tool case 25 pushes the grip wedges 33 into a tapered slot in the die case 23. The tapered slot causes the wedges 33 to tightly radially clamp onto the blank 21 and prevent the blank from movement under piercing loads.

Advance of the ram 17 causes the tool case 25 to contact and then drive the die case 23 into the die block 22. A study of FIGS. 3 and 4 shows that movement of the die case 23 into the die block 12 is accompanied by radially inward movement of the drivers or slides 41, 42. Radial movement of these drivers is developed by the cam 29 and flat cam follower surfaces 51, 52 on the primary driver cap 43 and the secondary driver 42, respectively. The angles of the contacting flat surfaces of the cam 29 and follower surfaces 51, 52 are complementary so that high forces are distributed over relatively large areas. These conditions allow high sideways forces to be generated reliably over a long service life.

A pusher 53 rigidly bolted to the tool case 25 engages the lower part of the primary driver 41 and secondary driver 42 to assure that these elements remain aligned with the die case groove 44 during their sideways stroke.

The pierce pins 36, guided by associated holes in the grip wedges 33 shear slugs of circular or other shape from the wall of the blank 21. Relative axial movement between the grip wedges 33 and the drivers 41, 42 is accommodated by T-slots 39 in the drivers in which the retraction sleeve flanges 38 are assembled. A mandrel 57 projecting from the blank delivery sleeve 46 supports the interior of the blank 21 during the piercing step. Screws 58 in the tool case 25 provide axial adjustment of the mandrel 57 so that holes in the mandrel are in line with the pierce pins 36. The slugs formed by the pierce pins 36 are swept out of the mandrel 57 by a vacuum applied to a tube 56.

When the tool case 25 and pusher 53 retract with the ram 17, the gas springs push the die case 23 out of the die block 22 to the position illustrated in FIGS. 2 and 3. The flat cam follower surfaces 51, 52 are keyed to the associated wedge surfaces 50, 54 with respective keys 59 of C-cross section. The keys 59 are assembled in aligned slots in the follower and cam surfaces 51, 52 and 50, 54 to provide a double-acting drive therebetween. As the drivers 41, 42 move axially with the die case 23, they are forced outwardly by the wedge or cam 29. This outward movement pulls the pierce pins 36 from the blank 21 allowing an ejector pin 61 to push the blank out of the die case 23.

The disclosed side action mechanism 28 is very strong for its size. As disclosed, the mechanism 28 is carried on the tooling so that it avoids modification of the basic parts of the machine 10. Consequently, the mechanism can be employed at substantially any workstation and can be used in machines that have been previously manufactured and are in field service.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A progressive former having a bolster and a ram reciprocal towards and away from the bolster, a plurality of workstations spaced evenly along the bolster and ram including aligned tooling case holders on the bolster and ram, a sideways forming mechanism at one of said workstations, the sideways forming mechanism including a slide guided for movement perpendicular to a line between the tooling case holders at said one station, the slide being arranged to be activated by forward motion of the ram towards the bolster, the sideways forming mechanism including a tool for forming a blank by applying a sideways motion with the slide on the blank.

2. A progressive former having a bolster and a ram reciprocal towards and away from the bolster, a plurality of workstations spaced evenly along the bolster and ram including aligned tooling piece holders on the bolster and ram, cylindrical die cases in the tooling holders on the bolster and cylindrical tool cases in the tooling holders on the ram, the cylindrical die cases and tool cases at the workstations being coaxial, a sideways forming mechanism at one of said workstations, the sideways forming mechanism including a cam and a cam follower radially outward of an associated cylindrical tool case or die case, the cam follower being arranged to be activated by forward motion of the ram towards the bolster, the sideways forming mechanism including a tool for forming a blank by applying a sideways force on the blank.

3. A progressive former having a bolster and a ram reciprocal towards and away from the bolster, a plurality of workstations spaced evenly along the bolster and ram including die blocks on the bolster and tool holders on the ram, die cases in the die blocks on the bolster and cylindrical tool cases in the tool holders on the ram, the cylindrical tool cases and die cases at the workstations being coaxial, a sideways forming mechanism at one of said workstations, the die case at said one workstation being retractable into the die block and carrying a slide of said sideways forming mechanism, a cam operable to direct the slide towards an axis of the one workstation when the die case retracts into the die block in response to the ram approaching front dead center, the slide carrying a piercing tool effective to displace a slug from a wall of a blank located at said one workstation.

4. A progressive former as set forth in claim 3, wherein the cam is carried on the die block.

5. A progressive former as set forth in claim 3, wherein the slide carries a secondary slide and the cam is a double-faced element, a first face being arranged to displace the slide and a second face being arranged to displace the secondary slide in a direction opposite the direction that the first mentioned slide is directed.

6. A progressive former as set forth in claim 5, wherein blank gripping elements are arranged to grip said blank in the die case when the ram approaches front dead center.

7. A progressive former as set forth in claim 3, including a mandrel carried by the tool case at said one station, the mandrel being receivable within a tubular blank to support a cylindrical wall of the blank when the cylindrical wall is pierced by said piercing tool.

* * * * *